US007562808B1

(12) United States Patent
Philips

(10) Patent No.: US 7,562,808 B1
(45) Date of Patent: Jul. 21, 2009

(54) CONTAINER

(75) Inventor: Nicholas A Philips, Sugar Grove, IL (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 12/137,766

(22) Filed: Jun. 12, 2008

(51) Int. Cl.
*B65D 5/42* (2006.01)
*B65D 5/24* (2006.01)

(52) U.S. Cl. ..... 229/148; 206/562; 206/565; 229/186; 229/904

(58) Field of Classification Search ..... 229/148, 229/186, 904; 206/562–565
See application file for complete search history.

(56) References Cited

U.S. PATENT DOCUMENTS 2,679,971 A * 6/1954 Goldberg ..... 229/904
2,924,372 A * 2/1960 Kirkeby ..... 229/904
4,511,042 A * 4/1985 Wischusen, III ..... 206/562
4,757,937 A * 7/1988 Maio et al. ..... 206/562
5,337,951 A * 8/1994 Roccaforte ..... 229/186
5,752,651 A * 5/1998 Correll ..... 229/150
6,568,586 B1 * 5/2003 VanEsley et al. ..... 229/904
7,004,314 B2 2/2006 Pucillo et al.
2004/0195144 A1 * 10/2004 Smith ..... 206/565
2004/0200891 A1 * 10/2004 Correll ..... 229/904
2007/0074993 A1 4/2007 Philips
2007/0131751 A1 * 6/2007 Rutledge ..... 229/148

* cited by examiner

*Primary Examiner*—Gary E Elkins

(57) ABSTRACT

A container having a product cavity formed by a bottom panel, front and back panels and end panels extending upwardly from the bottom panel. The front and back panels, a receptacle platform and a pair of support panels for the platform extend outwardly from at least one end wall. The receptacle platform has a receptacle aperture. A cover panel can overlie the product cavity and the platform and may have an aperture above the platform aperture.

7 Claims, 3 Drawing Sheets

CONTAINER

This invention is directed to a container with an auxiliary holding means.

In many food items, the main food item is accompanied with additional items such as sauces or dressings. These additional items are usually placed in small cups or receptacles. These cups or receptacles are then placed in the container with the main food item. This leads to a number of problems. If the main food item is hot then it will heat the sauce or dressing in the cup or receptacle which may have adverse effects on the sauce or dressing. The cup or receptacle will come into contact with the main food item. If the cup or receptacle is not sterile it can contaminate the main food item. The cup or receptacle may pick up elements of the main food item, such as grease or sauce, and become difficult or messy to handle. The cup or receptacle is loose within the container and may become dislodged or fall out of the container before it is finally delivered.

It would be advantageous to eliminate these problems by separating the cup or receptacle from the main food item.

Although the container has been discussed in relation to food items it should be noted that the cup or receptacle could contain screws, bolts, nails or other hardware if the container contains a project to be formed, or could contain batteries for a toy or other electronic device.

DETAILED DESCRIPTION

The container is illustrated with a single cup or receptacle. It will be understood that the container can accommodate more than a single cup or receptacle. This can be done by having receptacle platforms at each end of the container. The number of cups that can be accommodated by a receptacle platform will depend on the width of the container. A wide container can hold two or more receptacle on the platform.

The term "attachment line" is used throughout the application. The attachment lines may be score lines, reverse score lines or cut and score lines depending upon the requirements for the particular line.

Figure 1:
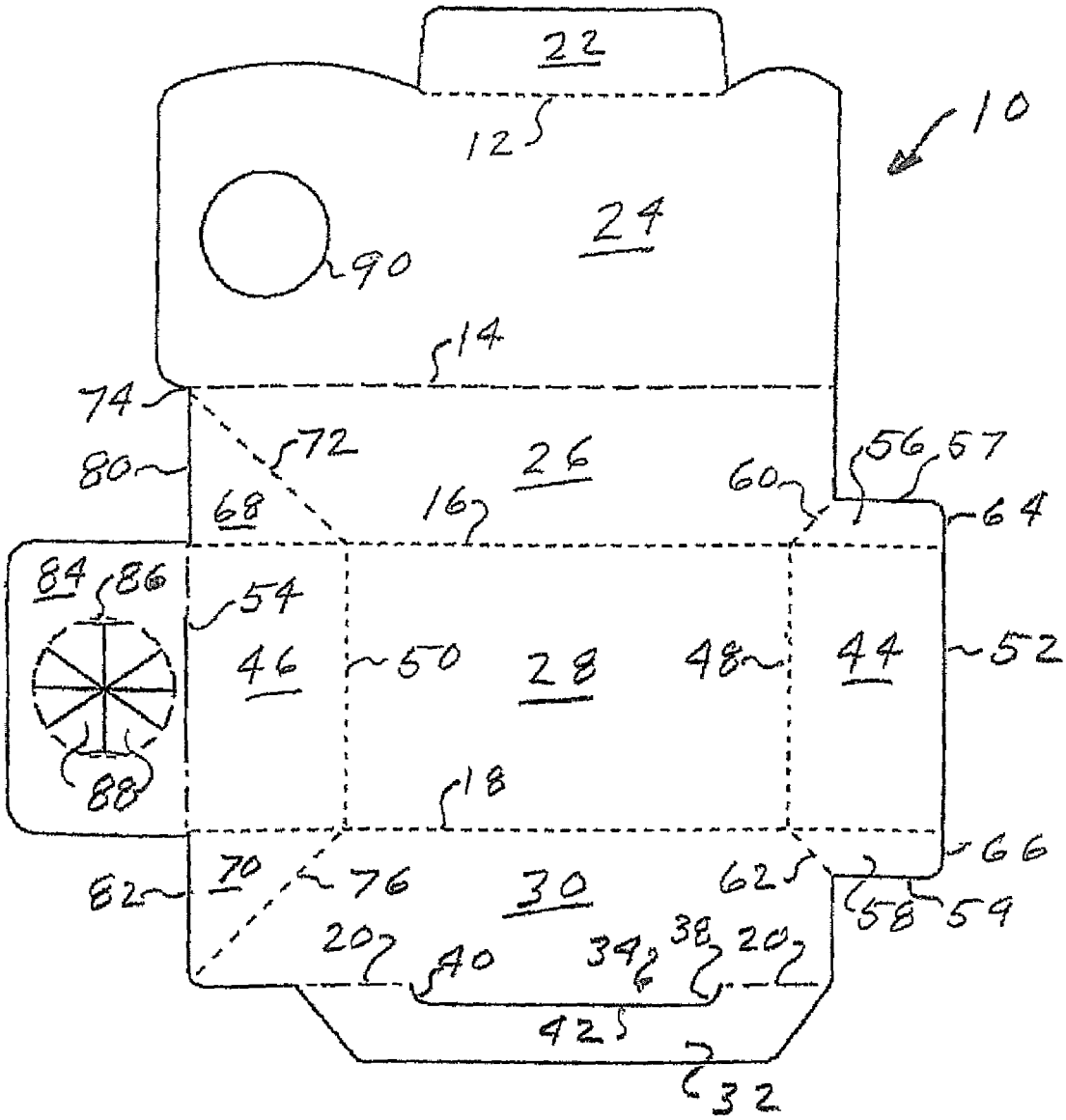
FIG. 1 is a top plan view of a blank for the container
Figure 2:
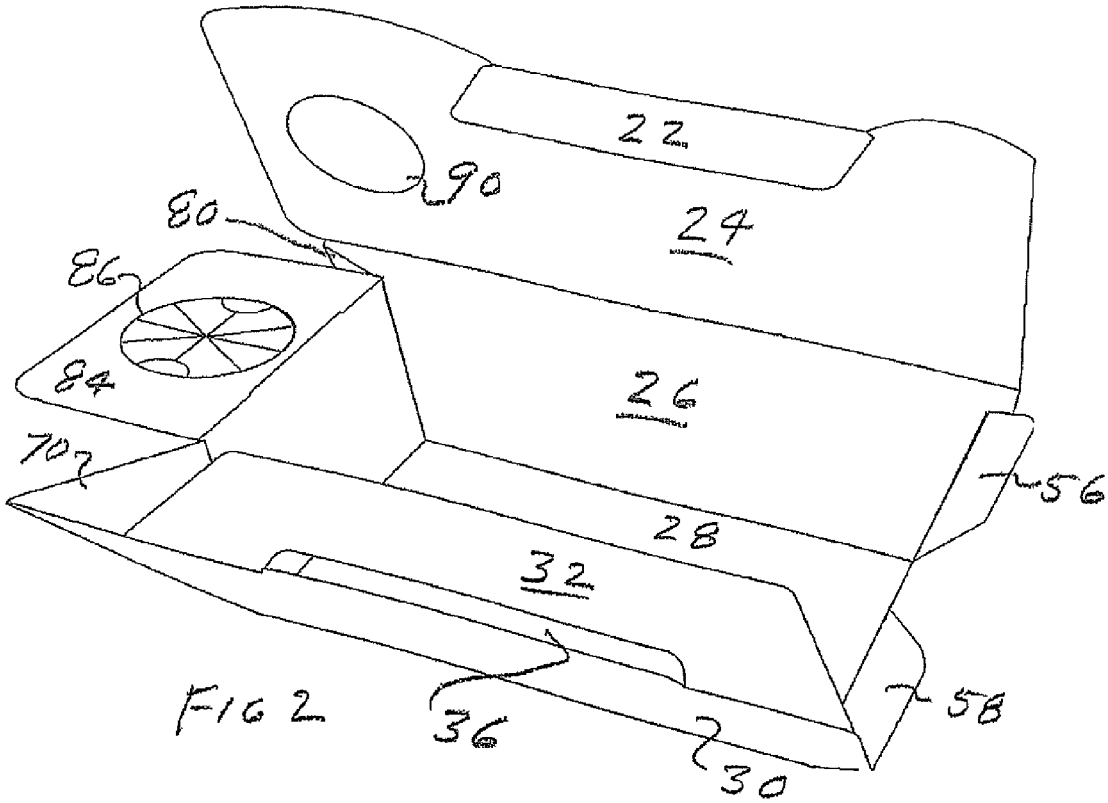
FIG. 2 is an isometric view of a partially assembled container.
Figure 3:
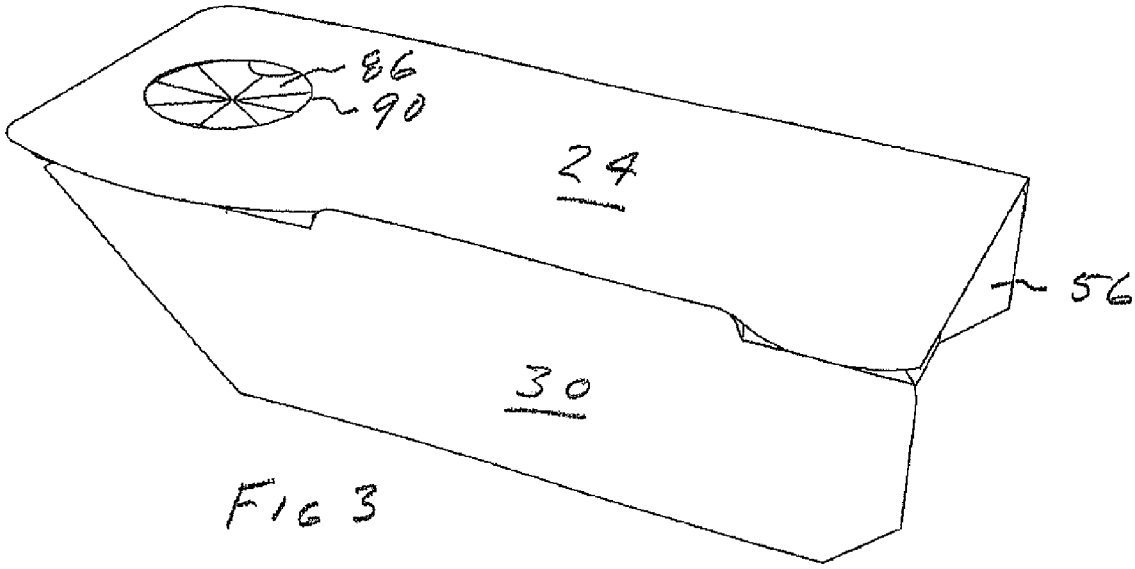
FIG. 3 is an isometric view of the closed container.

In FIG. 1, the blank 10 is divided by parallel longitudinal attachment lines 12, 14, 16, 18 and 20 into a closure flap 22, a cover panel 24, a back panel 26, a bottom panel 28, a front panel 30 and a closure panel 32. Attachment line 20 is in two sections. A cut line 34 extends between the two sections of attachment line 20. The cut line 34 forms a closure aperture 36 in the closure panel 32. The cut line 34 has two ends 38 and 40 which extend outwardly from attachment line 20 and a central section 42 which is parallel to and offset from attachment line 20. The closure aperture 36 is wide enough to accommodate the closure flap 22.

End panels 44 and 46 are attached to opposite ends of bottom panel 28 along parallel transverse attachment lines 48 and 50. The side edges of the end panels 44 and 46 are defined by the attachment lines 16 and 18. End panels 44 and 46, front panel 30 and back panel 26 have the same height in the erected container so for all of these panels the distance is the same between the attachment line between the panel and the bottom panel 28 and the side opposite the attachment line between the panel and the bottom panel 28. The distance is the same between attachment lines 16 and 12, between attachment lines 18 and 20, between attachment line 48 and the opposite edge 52 of end panel 44, and the distance between attachment line 50 and the attachment line 54 forming the opposite edge of end panel 46.

Side flaps 56 and 58 are attached to the side edges of end panel 44 along attachment lines 16 and 18 respectively. Side flap 56 is attached to the back panel 26 by diagonal attachment line 60 which extends from the juncture of attachment lines 16 and 48 to the juncture of the side edge of back panel 26 and outer side edge 57 of side flap 56. Side flap 58 is attached to the front panel 30 by diagonal attachment line 62 which extends from the juncture of attachment lines 18 and 48 to the juncture of the side edge of front panel 30 and the outer side edge 59 of side flap 58. The outer edges 64 and 66 of side flaps 56 and 58 are aligned with the opposite edge 52 of end panel 44. The outer edges 64 and 66 of the flaps 56 and 58 are supports for the cover 24 in the formed container.

Triangular support panels 68 and 70 are attached to the side edges of end panel 46 along the attachment lines 16 and 18 respectively. Support panel 68 is attached to back panel 26 by diagonal attachment line 72 which extends from the juncture of attachment lines 16 and 48 to the outer corner 74 of back panel 26, the juncture of the top edge of back panel 26 with the top edge of support panel 68. Support panel 70 is attached to front panel 30 by diagonal attachment line 76 which extends from the juncture of attachment lines 18 and 48 to the outer corner 78 of front panel 30, the juncture of the top edge of front panel 30 with the top edge of support panel 70. The outer edges 80 and 82 of support panels 68 and 70, respectively, are aligned with the opposite edge 54 of end panel 46. The support panels support the receptacle platform 84 and the cover 24 in the formed container.

Receptacle platform 84 is attached to end panel 46 along the attachment line 54 forming the opposite edge of the end panel 46. The receptacle platform 84 has an aperture 86 for holding the cup or receptacle. The aperture is shown as formed of a number of cut wedges 88 that surround the cup or receptacle in the filled container but may be open.

The receptacle platform has been shown with one aperture 86 but could be provided with additional apertures if the container had an appropriate width from front to back. If needed an additional receptacle platform and support structure could be formed on end panel 44.

The cover panel 24 may have an aperture or apertures 90 which align with the aperture or apertures 86 in the formed container. The aperture 90 should be equal to or smaller than the top of the cup or receptacle to hold the cup or receptacle in place. The aperture 90 should have the same or a smaller diameter or size than the aperture 86.

In forming the container, the front panel 30, back panel 26, and end panels 44 and 46 are bent upwardly around attachment lines 18, 16, 48 and 50. The support panels 68 and 70 and the side flaps 56 and 58 are bent outwardly around attachment lines 14 and 16 and diagonal attachment lines 72, 76, 60 and 62. The receptacle platform 84 is bent downwardly around attachment line 54 to rest on the support panels 68 and 70 and the front and back panels 30 and 26. The receptacle or receptacle 92 are placed in the apertures 86 and the main item is placed in the cavity formed by the front panel 30, back panel 26, end panels 44 and 46 and bottom panel 28. The closure panel 32 is bent downwardly around attachment line 20 forming the closure aperture 36. The cover panel 22 is bent downwardly around attachment line 14 and the closure flap 22 is inserted into closure aperture 36. The closure aperture or apertures 90 will be over the receptacle or receptacles 92 holding the receptacle or receptacles is place and allowing the purchaser to see what is in the receptacle or receptacles.

Although the front, back and end panels of the container are shown as being perpendicular to the bottom panel in the formed container, it should be understood that these panels can be angled outwardly from the bottom panel is some embodiments.

Figure 4:
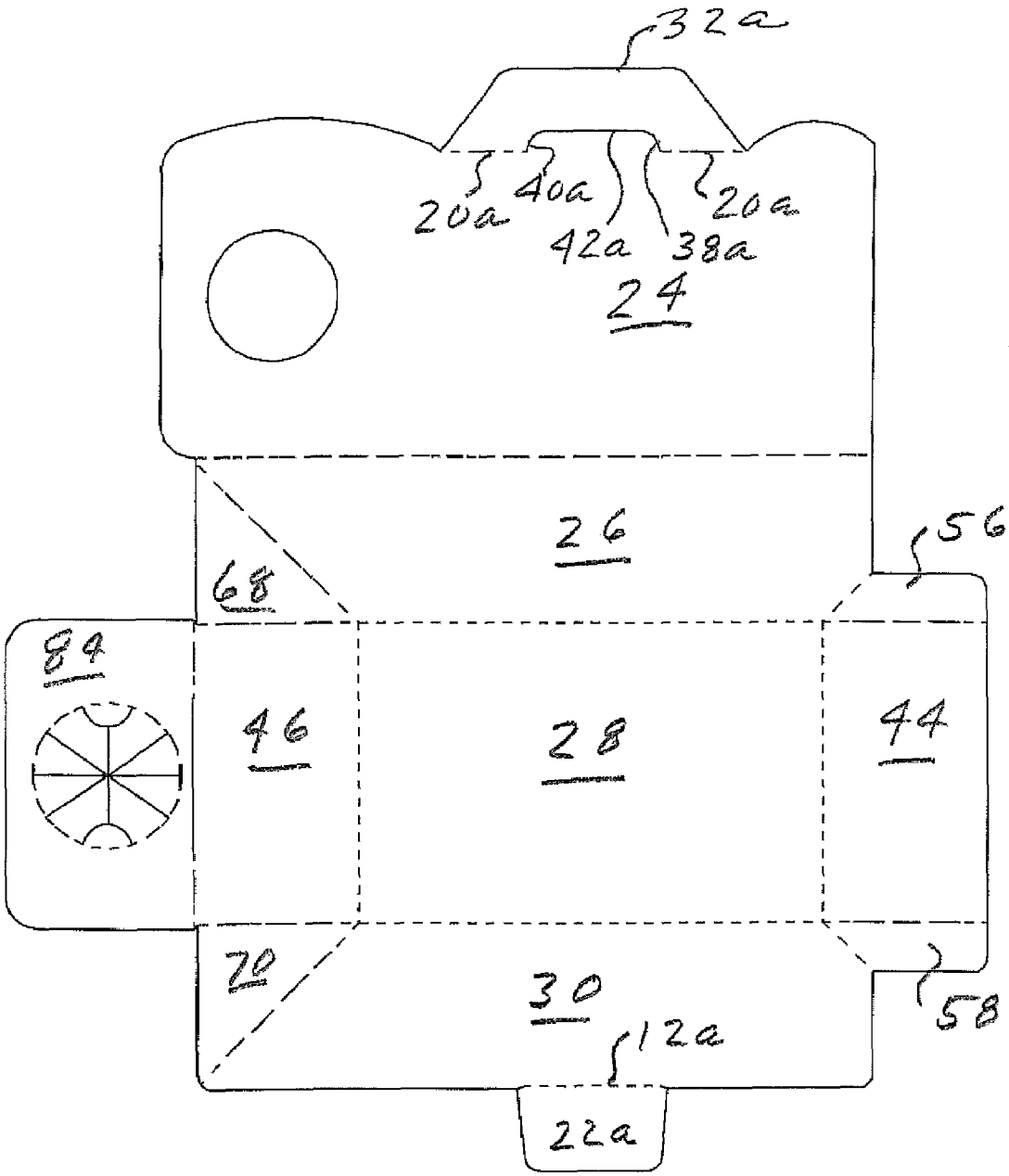
FIG. 4 is a top plan view of a blank for another embodiment of the container.

FIG. 4 shows the blank for another embodiment of the container. In this embodiment the position of the closure flap 22 with its attachment line 12 and the closure panel 32 with its attachment line 20 and cut line 34 are reversed. The closure panel 32*a* is attached to cover panel 24 along attachment line 20*a* and cut line 34*a*, and the closure flap 22*a* is attached to front panel 30 along attachment line 12*a*. All other parts of the container remain the same and the reference numerals are the same. The container is still closed by placing closure flap 22*a* through closure aperture 36*a* formed by the cut line 34*a*.

The material of construction may be corrugated board or fiberboard.

It will be understood that other changes can be made without departing from the spirit of the invention.

The invention claimed is:

1. A container blank comprising:

a single piece of corrugated material divided by first and second longitudinal parallel attachment lines to define front, bottom, and back panels, a first transverse attachment line at one end of the bottom panel, the first transverse attachment line separating the bottom panel from a first end panel, a second transverse attachment line at the opposite end of the bottom panel, the second transverse attachment line being parallel to the first transverse attachment line, the second transverse attachment line separating the bottom panel and a second end panel, a first support panel attached to the front panel and the first end panel, the first support panel being attached to said first end panel along the first longitudinal attachment line I and being attached to the front panel by a diagonal attachment line extending from the juncture of the first longitudinal attachment line and the first transverse attachment line to the juncture of the top edge of the front panel with the top edge of the first support panel, a second support panel attached to the back panel and the first end panel, the second support panel being attached to said first end panel along the second longitudinal attachment line and being attached to the back panel by a diagonal attachment line extending from the juncture of the second longitudinal attachment line and the first transverse attachment line to the juncture of the top edge of the back panel with the top edge of the second support panel, the top edge of the first end panel being defined by an attachment line which is aligned with the top edges of the first and second support panels, a receptacle platform attached to the top edge of the first end panel along the attachment line, an aperture formed in the receptacle platform.

2. The blank of claim 1 further comprising a first side flap attached to the front panel and the second end panel, the first side flap being attached to said second end panel along the first longitudinal attachment line and being attached to the front panel by a diagonal attachment line extending from the juncture of the first longitudinal attachment line and the second transverse attachment line to the juncture of the side edge of the front panel with the outer side edge of the first side panel, a second side flap attached to the back panel and the second end panel, the second side flap being attached to said second end panel along the second longitudinal attachment line and being attached to the back panel by a diagonal attachment line extending from the juncture of the second longitudinal attachment line and the first transverse attachment line to the juncture of the side edge of the back panel with the outer side edge of the second side flap.

3. The blank of claim 1 further comprising a cover panel attached to the back panel along a third longitudinal attachment line opposite the second longitudinal attachment line, a closure panel attached to the front panel along a fourth longitudinal attachment line, the fourth longitudinal attachment line being opposite the first longitudinal attachment line and being in two parts separated by a cut line offset from the fourth longitudinal attachment line, a closure flap attached to the cover panel by a fifth longitudinal attachment line opposite the third longitudinal attachment line, the closure flap being aligned with the cut line.

4. The blank of claim 3 further comprising an aperture in the cover panel which is aligned with the aperture in the receptacle platform in the formed container, the cover panel aperture having a maximum size that is equal to the size of the receptacle platform aperture.

5. The blank of claim 1 further comprising a cover panel attached to the back panel along a third longitudinal attachment line opposite the second longitudinal attachment line, a closure panel attached to the cover panel along a fourth longitudinal attachment line, the fourth longitudinal attachment line being opposite the third longitudinal attachment line and being in two parts separated by a cut line offset from the fourth longitudinal attachment line, a closure flap attached to the front panel by a fifth longitudinal attachment line opposite the first longitudinal attachment line, the closure flap being aligned with the cut line.

6. The blank of claim 5 further comprising an aperture in the cover panel which is aligned with the aperture in the receptacle platform in the formed container, the cover panel aperture having a maximum size that is equal to the size of the receptacle platform aperture.

7. A container comprising a bottom panel, front and back panels attached to the bottom panel by first and second attachment lines, first and second end panels attached to the bottom panel by first and second transverse attachment lines, a first support panel extending outwardly of the first end panel and being attached to a side of the first end panel and a side of the front panel, a second support panel extending outwardly of the first end panel and being attached to a side of the first end panel and a side of the back panel, a receptacle platform extending outwardly from the top of the first end panel, the receptacle platform having an aperture formed therein a first side flap extending outwardly from the second end panel, the first side flap being attached to a side of the second end panel and a side of the front panel, a second side flap extending outwardly from the second end panel, the second side flap being attached to a side of the second end panel and a side of the back panel, a cover panel attached to the back panel, a closure flap attached to the cover panel on the side opposite the attachment of the cover panel to the back panel the front panel having an upper edge, a closure panel attached to the front panel along the upper edge, a closure aperture formed between the closure panel and the front panel, the closure flap extending into the closure aperture, and an aperture in the cover panel aligned with the aperture in the receptacle platform, the cover panel aperture being equal to or smaller than the receptacle platform aperture.

* * * * *